US006695428B2

(12) United States Patent
Kao et al.

(10) Patent No.: US 6,695,428 B2
(45) Date of Patent: Feb. 24, 2004

(54) METHOD AND DEVICE FOR BALANCED SERVICE OF INK JET NOZZLES

(75) Inventors: Chih-Hung Kao, Taipei (TW); Yu-Fan Fang, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 171 days.

(21) Appl. No.: 09/682,309

(22) Filed: Aug. 16, 2001

(65) Prior Publication Data

US 2003/0038855 A1 Feb. 27, 2003

(30) Foreign Application Priority Data

Oct. 5, 2000 (TW) ..... 89120756 A

(51) Int. Cl.[7] ..... B41J 2/165
(52) U.S. Cl. ..... 347/23
(58) Field of Search ..... 347/23, 29, 30, 347/35, 14, 10, 19; 358/296

(56) References Cited

U.S. PATENT DOCUMENTS 5,583,547 A 12/1996 Gast et al. ..... 347/22
5,793,388 A * 8/1998 Martinson et al. ..... 347/19
5,850,237 A * 12/1998 Slade ..... 347/23
6,234,604 B1 * 5/2001 Kawakami et al. ..... 347/23

* cited by examiner

*Primary Examiner*—Shih-Wen Hsieh
(74) *Attorney, Agent, or Firm*—Winston Hsu

(57) ABSTRACT

An ink jet printing device has an ink jet printing head capable of moving back and forth along a print track to perform a printing job. The ink jet printing head has a plurality of nozzles and corresponding driving units. The servicing method has the steps: (1) recording status of each driving unit; (2) determining a service job corresponding to each individual driving unit with a predetermined rule according to the corresponding status of each driving unit when the ink jet printing head needs to be serviced, and (3) driving each driving unit to perform the corresponding service job.

26 Claims, 5 Drawing Sheets

METHOD AND DEVICE FOR BALANCED SERVICE OF INK JET NOZZLES

BACKGROUND OF INVENTION

1. Field of the Invention

The present invention relates to a method and device for servicing the ink jet printing heads of ink jet printers, photostats, or fax machines. More particularly, the present invention discloses a servicing method and device where servicing jobs are performed according to the individual status of each nozzle and corresponding driving unit on the ink jet printing head.

2. Description of the Prior Art

Ink jet printing devices typically have an ink jet printing head capable of moving along a print track. The ink jet printing head comprises an ink storage unit for containing ink, a plurality of nozzles, and corresponding driving units for the nozzles. The driving units, such as heaters, can be driven by signals sent from a controller. The driving units, when receiving signals from the controller, can heat ink in the ink storage unit so that the corresponding nozzles on the printing head can jet ink drops to form ink spots on the printing medium to print. Demand of higher printing resolution and speed leads to smaller sizes of nozzles and higher jetting frequency of nozzles (that is, the nozzles have to jet ink more frequently within a unit time). Therefore it becomes even more important to maintain the nozzles in good condition so that each nozzle can function properly.

It is common that an ink jet printing device comprises a servicing device to service the ink jet printing head. The servicing device usually forms a servicing station which has a wiper to wipe the ink jet printing head. After the ink jet printing head moves into the servicing device, the wiper scrapes away remaining ink near nozzles on the ink jet printing head. Different approaches have been proposed for determining an appropriate time to move the ink jet printing head into the servicing device. One example is to service the ink jet printing head when the nozzles on the printing head have jetted ink for a fixed number of times. Another example is to service the ink jet printing head when the printing head has performed printing for a fixed period of time. U.S. Pat. No. 5,583,547 disclosed a more sophisticated determination method. The method includes counting the number of ink drops jetted from each of the nozzles so as to determine an appropriate time to service the ink jet printing head.

However, in U.S. Pat. No. 5,583,547 the servicing device services the entire printing head regardless the different status of each nozzle. Since in a printing job each driving unit and its corresponding nozzle may be driven to jet ink for different number of times, the temperature of each individual driving unit and corresponding nozzle, and the build-up or bubbles accumulated near different driving unit or its corresponding nozzle become various on the same printing head. The differences will cause ink jet printing head instability and therefore degrade printing quality. The prior art disclosed in U.S. Pat. No. 5,583,547 only services the whole ink jet print head without considering the differences between nozzles on the printing head, and thus cannot balance the aforementioned differences between nozzles to obtain satisfactory printing quality.

SUMMARY OF INVENTION

It is therefore a primary objective of the present invention to provide a servicing method that compensates the different status of each driving unit and corresponding nozzle and thus improves printing quality.

According to the embodiment of the present invention, the ink jet printing device comprises an ink jet printing head capable of moving back and forth along a print track to perform a printing job. The ink jet printing head has a plurality of driving units and corresponding nozzles to jet ink drops. The ink jet printing device further comprises a recording module to record the number of times each driving unit is driven to jet ink by the controller. When a predetermined servicing condition has been satisfied and the ink jet printing head needs servicing, different service jobs are performed for different driving unit and corresponding nozzle on the printing head.

It is an advantage of the present invention that the servicing method considers and compensates the different status of each driving unit and its corresponding nozzle. Therefore the differences between the driving units and corresponding nozzles are minimized, and the printing quality can therefore be improved.

These and other objectives and advantages of the present invention will no doubt become obvious to those of ordinary skill in the art after having read the following detailed description of the preferred embodiment that is illustrated in the various figures and drawings.

DETAILED DESCRIPTION

Figure 1:
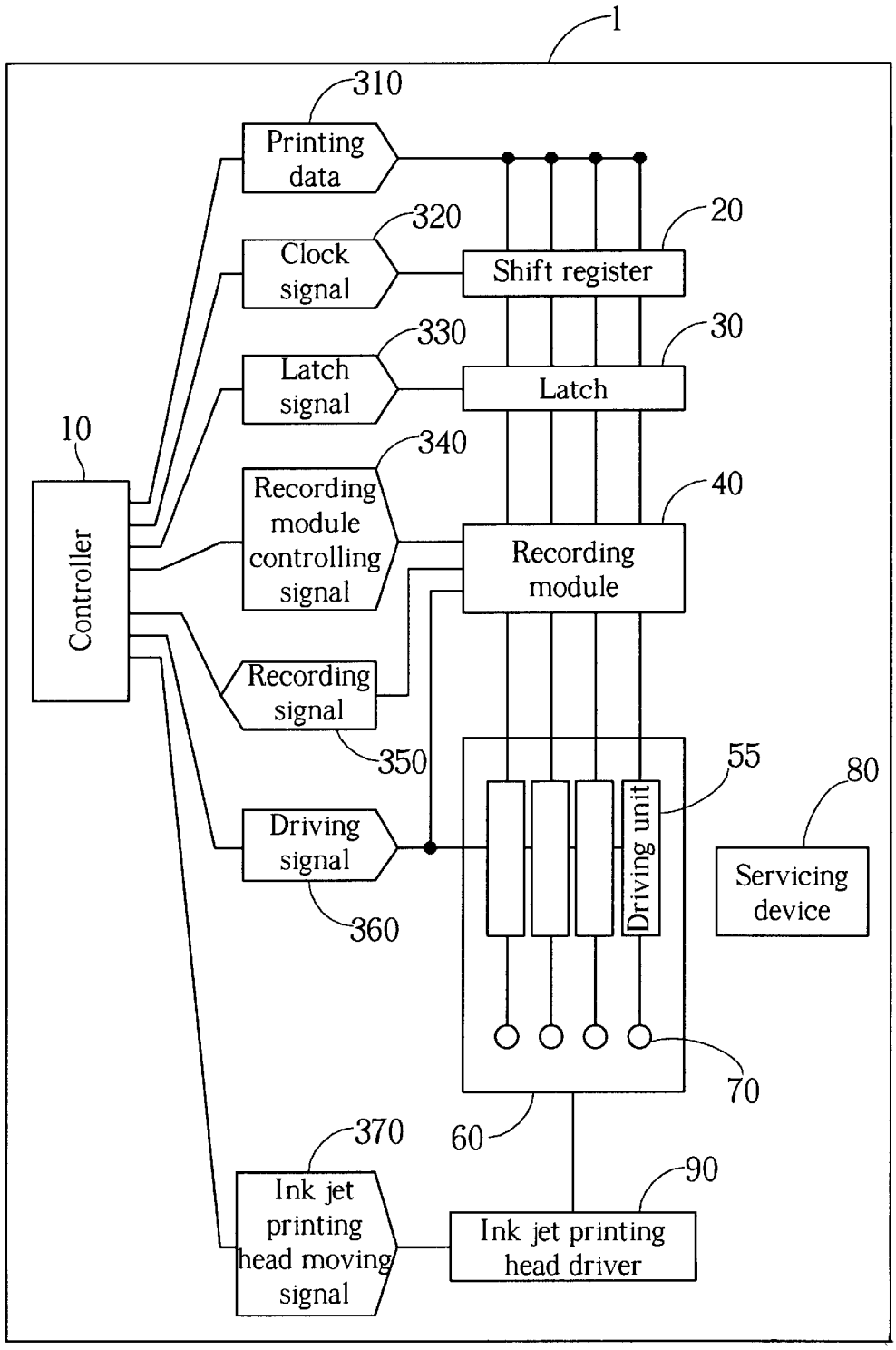
FIG. 1 is a block diagram of the present invention servicing method used in an ink jet printing system.

Please refer to FIG. 1. FIG. 1 is a block diagram of the present invention servicing method used in an ink jet printing system 1. The ink jet printing system comprises a controller 10, a shift register 20, a latch 30, a recording module 40, an ink jet printing head 60 comprising a plurality of driving units 55 and corresponding nozzles 70, an ink jet printing head driver 90 to make the ink jet printing head 60 move back and forth along a print track(not shown), and a servicing device 80 to service the ink jet printing head 60.

The way the ink jet printing system works can be described as follows. The controller 10 transmits printing data 310 to the shift register 20 with the trigger of the pulsed clock signal 320. The printing data 310 consists of printing signals corresponding to each nozzle. After the printing signals corresponding to the nozzles are all shifted in the shift register 20, the controller 10 uses a latch signal 330 to latch the printing data 310 from the shift register 20 to the latch 30. Then the controller 10 sends a driving signal 360 to the driving unit 55 such that the corresponding nozzle 70 jets ink drops onto the medium, such as paper (not shown in the figure). In the process of ink jet printing, the controller 10 also sends an ink jet printing head moving signal 370 to the ink jet printing head driver 90 so that the ink jet printing head driver 90 can move the ink jet printing head 60 to a proper position along the print track.

To evaluate and compensate the different status of each driving unit 55 and corresponding nozzle 70, the number of times each driving unit 55 and its corresponding nozzle 70 are driven to jet ink is recorded. In the preferred embodiments of the present invention, a recording module 40 is used to record the number of times each driving unit 55 is driven. As shown in FIG. 1, the recording module 40, similar to the driving unit 55, is also triggered by the driving signal 360. When the driving signal 360 drives each driving unit 55 to jet ink, the driving signal 360 also activates the recording module 40 to record the number of times each driving unit 55 is driven. The recording module 40 can transmit a recording signal 350 to the controller 10 to indicate the number of times each driving unit is driven. Also, the controller 10 can send a recording module controlling signal 340 to control the recording module 40 to perform some functions, such as resetting the records about the number of times for each driving units 55 to jet ink. In this embodiment, the recording module 40 is implemented by hardware counters. However, it could also be implemented by a software program which analyzes the printing data 310 and records the number of times each driving unit 55 is driven to jet ink.

Figure 2:
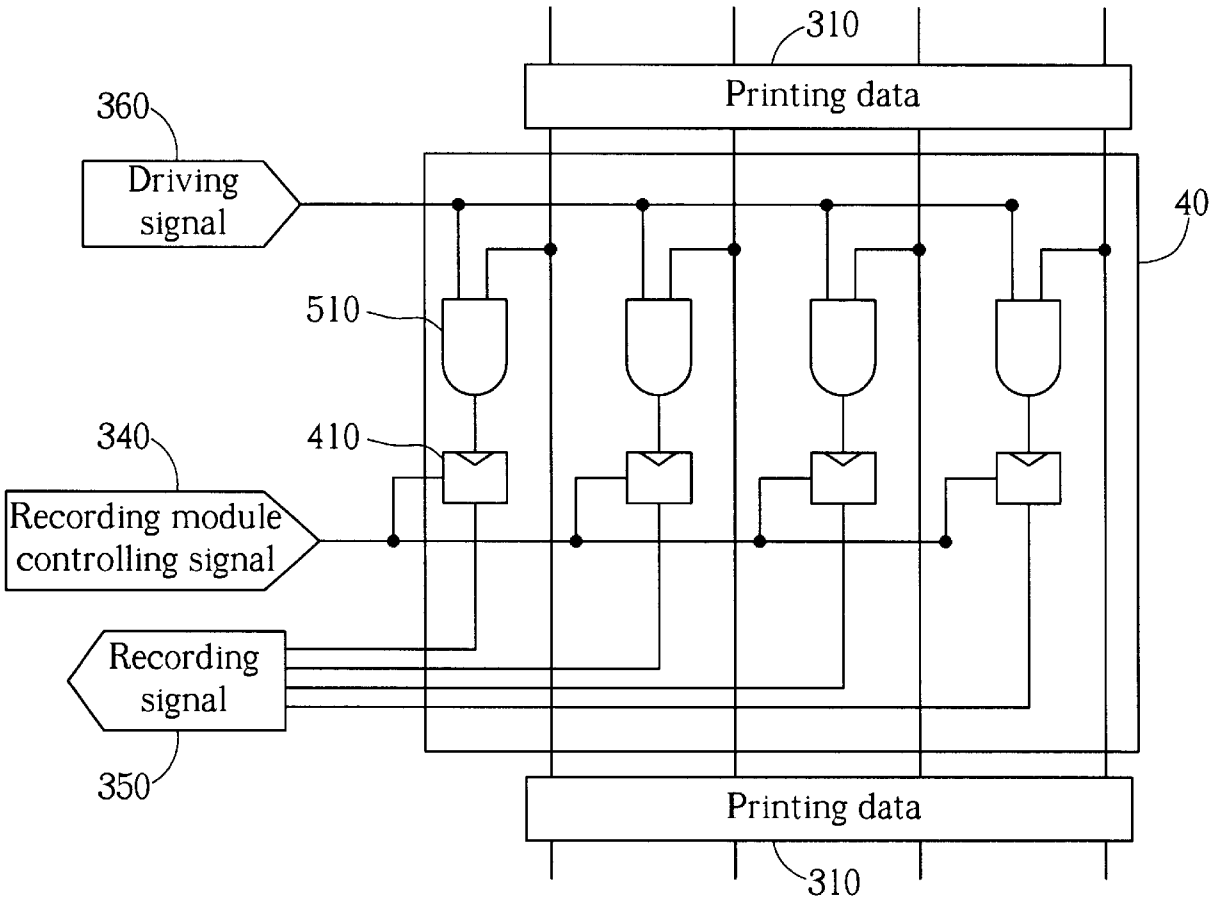
FIG. 2 is a diagram of a structure of a recording module shown in FIG. 1.

In the following preferred embodiment, the recording module 40 uses a plurality of counters to record the number of times each driving unit 55 is driven to jet ink. Please refer to FIG. 2. FIG. 2 is a circuit schematic diagram of the recording module 40 shown in FIG. 1. The recording module 40 comprises a plurality of counters 410 and AND gates 510 corresponding to each driving unit 55. Each AND gate 510 has two inputs; one input connects to the latch 30 to receive the printing data 310 corresponding to the nozzle 70; and the other input connects to the controller 10 to receive the driving signal 360. Each counter 410, which records the number of times each driving unit 55 is driven, is controlled by the corresponding AND gates 510. If a driving unit 55 is expected to jet ink, the printing data 310 corresponding to the driving unit 55 would be "high"; if a driving unit 55 is expected not to jet ink, the printing data 310 corresponding to the driving unit 55 would be "low". When the controller 10 controls some nozzles 70 to jet ink drops, the logic "high" driving signals 360 are transmitted to one input of each AND gate 510 in the recording module 40. Therefore, for a driving unit 55 driven to jet ink, both inputs of the corresponding AND gate 510 are "high" to make the AND gate also sends "high" to trigger the corresponding counters 410 to increment. Meanwhile, if a nozzle is not driven to jet ink, the printing data 310 corresponding to the nozzle are logic "low", then the corresponding counters 410 will not increment. The counting result of the counters 410 is sent back to the controller 10 via the recording signal 350. Also, the controller 10 is capable of enabling, disabling, or resetting each counter 410 via the recording module controlling signal 340.

When a predetermined servicing condition has been satisfied and the ink jet printing head 60 needs servicing, the controller 10 moves the ink jet printing head 60 into the ink jet servicing device 80 to be serviced. The servicing condition can be whether the ink jet print head has completed a certain amount of printing, or whether the ink jet print head has performed printing for a certain period of time. In the prior art, the ink jet printing head is serviced only by uniformly wiping all nozzles 70 of the ink jet printing head 60. In the present invention, the servicing method further comprises recording the number of times of each driving unit 55 and its corresponding nozzle 70 are driven to jet ink, and compensating the differences among all driving units 55 and corresponding nozzles 70. The present invention identifies and compensates the different status of each driving unit 55 and corresponding nozzle 70 on the printing head 60. Therefore a better printing quality can be achieved.

The way the present invention works can be described as follows. After the ink jet printing head 60 moves into the servicing device 80, the controller 10 retrieves the number of times each driving unit 55 has been driven from the recording module 40. The controller 10 then determines a service job for each driving unit 55, according to the number of times each nozzle 70 and corresponding driving unit 55 are driven. The number of times each driving unit 55 has been driven is compared with a minimum driving number and a reference driving number. If a driving unit has been driven for a number of times less than the minimum driving number, the controller 10 will drive the driving unit 55 with a first driving signal. The first driving signal can be designed to drive the driving unit 55 to heat up, but not to jet ink drops. Also, the first driving signal can be designed to drive the driving unit 55 to jet ink drops for several times until the number of times the driving unit 55 is driven (with power used in the normal printing way) reaches the minimum driving number. This method compensates the differences among different driving units 55 and corresponding nozzles 70. The differences include the temperature difference of the ink contained in the ink storage unit near different nozzles 70, and the temperature difference of the driving units 55 themselves.

On the other hand, if a driving unit 55 has been driven for a number of times larger than the reference driving number, it implies that the driving unit 55 has been driven frequently, and that the driving unit 55 or its corresponding nozzle 70 may have bubbles or build-up accumulated nearby, which may hinder the normal printing. In this situation, the controller 10 drives the driving unit 55 with a second driving signal. The second driving signal could be a moderate driving signal that drives the driving unit 55 to heat up slowly and continually for a certain period of time. Or the second driving signal could also be a peaked driving signal that drives the corresponding driving unit 55 to perform short and high-energy heating. The second driving signal may have different forms, but the purpose is to eliminate bubbles or build-up accumulated near the driving unit 55 or its corresponding nozzle 70. The form and parameters (such as signal duration and power) of the second driving signal can be adjusted according to the ink type, the nozzle size, the time available to perform the servicing job, the forms of the normal driving signal and other factors.

During the servicing job, the controller 10 may use the recording module 40 to continue monitoring the status of each driving unit 55, such as recording the number of times each driving unit 55 is driven. After servicing the driving units 55 corresponding to their individual status, the controller 10 can reset all counters 410 in the recording module 40 via the recording module controlling signal 340. The recording module 40 can then continue to count the number of times each driving unit 55 is driven in future printing process. Alternatively, the controller 10 can disable all counters 410 in the recording module 40 during the servicing job, and reset all counters 410 when all driving units 55 have been serviced with the recording module controlling signal 340. Then, the recording module 40 continues to count the number of times each driving unit 55 is driven in future printing processes. The present invention servicing method may also include wiping remaining ink on all nozzles with a wiper in the servicing device 80.

As discussed above, the present invention includes determining a minimum driving number and a reference driving number. The minimum driving number represents the minimum number of times to stabilize the driving unit 55 and its corresponding nozzle 70. The driving units 55 not driven for enough number of times may suffer from large temperature difference comparing to other driving units, and such temperature difference can seriously degrade printing quality. Therefore, in the present invention servicing method, the driving unit 55 that has been driven less than the minimum driving number is serviced by being heated to increase the temperature, or by being driven to jet ink several times with power used in normal printing. For the present invention, several approaches for determining the minimum driving number and the reference driving number are disclosed in the following.

Figure 3:
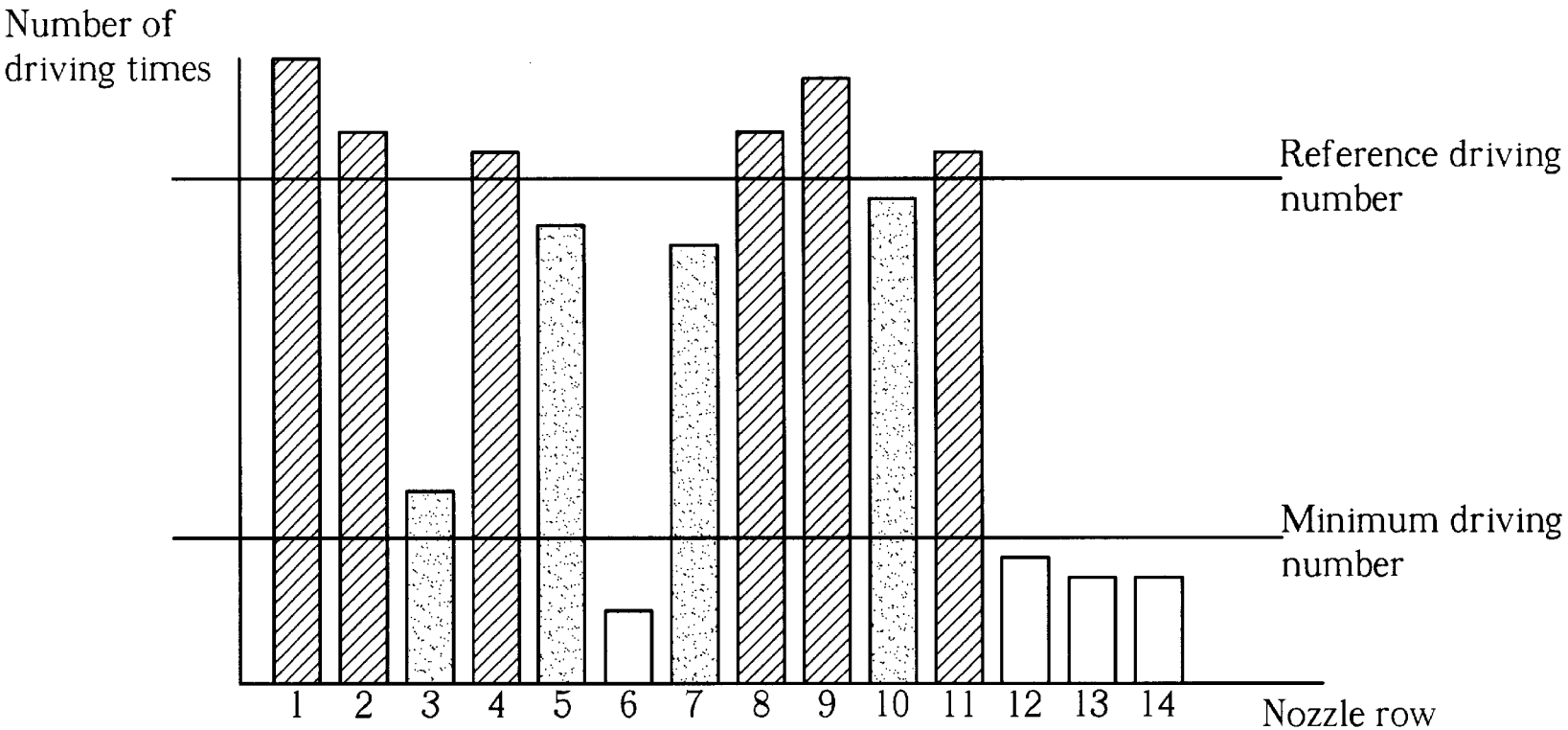
FIG. 3 is a diagram of a first preferred embodiment for determining a reference driving number and a minimum driving number.

Please refer to FIG. 3. FIG. 3 shows a first embodiment of the present invention for determining the reference driving number and the minimum driving number. In FIG. 3, the horizontal axis represents the identification of different driving unit 55 (as an example, there are 14 driving units respectively labeled as 1 to 14), and the vertical axis represents the number of times each driving unit 55 is driven. In this embodiment, the reference driving number and the minimum driving number are both fixed values. The darker (with slashed pattern)bars in FIG. 3 represent the driving units 55 which have been driven more than the reference driving number, and the white bars represent the driving units 55 which have been driven less than the minimum driving number.

An algorithm can also be used to determine the minimum driving number. The algorithm may comprise generating a new minimum driving number each time the printing head 60 needs servicing. Therefore the minimum driving number reflects the variation in different situation and can better modify the required servicing job corresponding to each driving unit 55.

Figure 4:
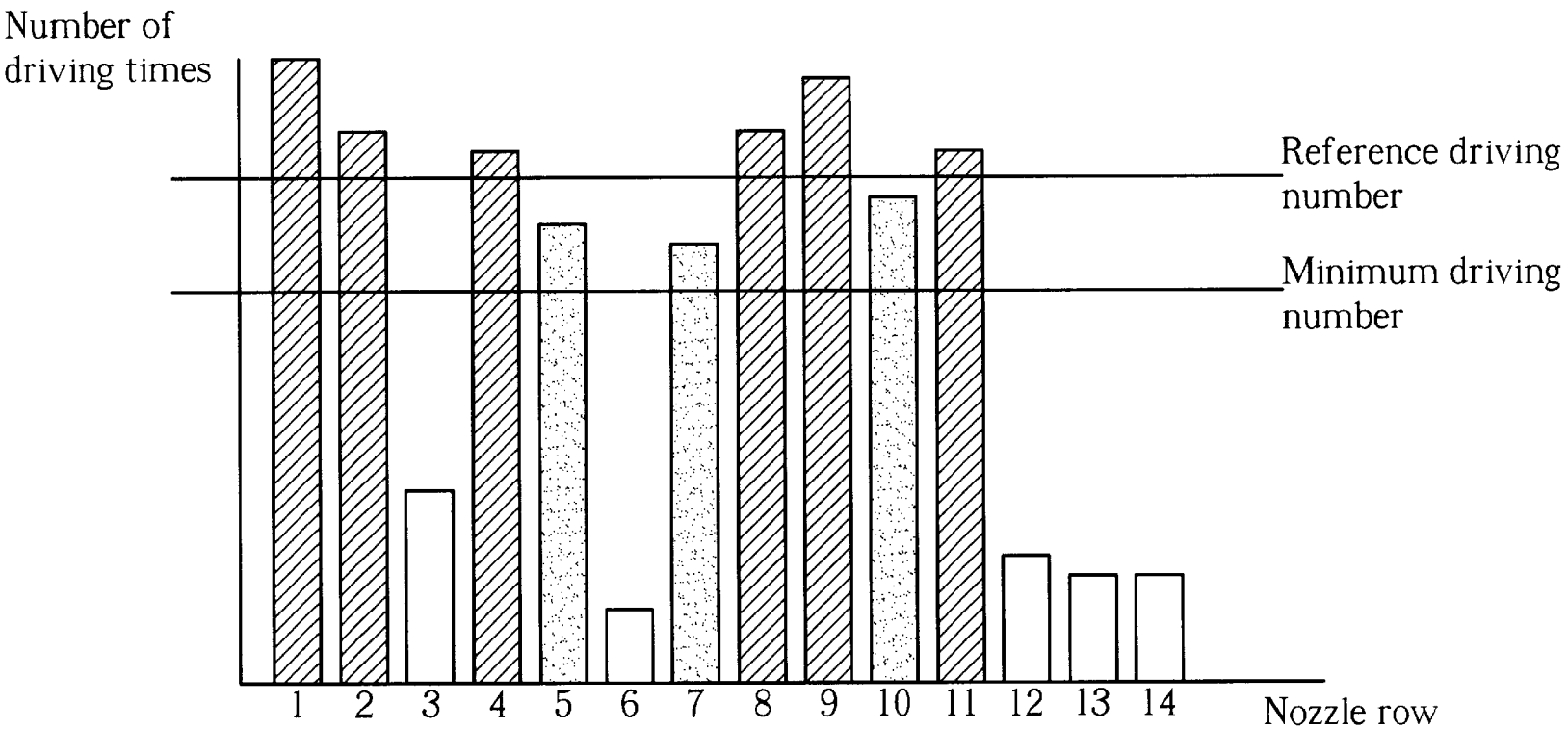
FIG. 4 is a diagram of a second preferred embodiment for determining a reference driving number and a minimum driving number.

Please refer to FIG. 4. The data in FIG. 4 is the same as that in FIG. 3, however, in FIG. 4 the minimum driving number is the rounded-off average over the numbers of times all driving units 55 are driven to jet ink. Additionally, the reference driving number may also be determined based on the standard deviation of the data (i.e., the numbers of times the driving units 55 are driven). If the standard deviation is not large (less than a pre-determined value), it represents that the difference between each driving unit is not significant. On the other hand, if the standard deviation is large (larger than the pre-determined value), it represents that there are great differences among different driving units 55, thus the driving units 55 should be serviced according to their corresponding status so as to minimize their differences. Other statistical techniques can also be used to determine the minimum driving number and the reference driving number such that the servicing jobs required for corresponding driving units can be performed with flexibility.

Figure 5:
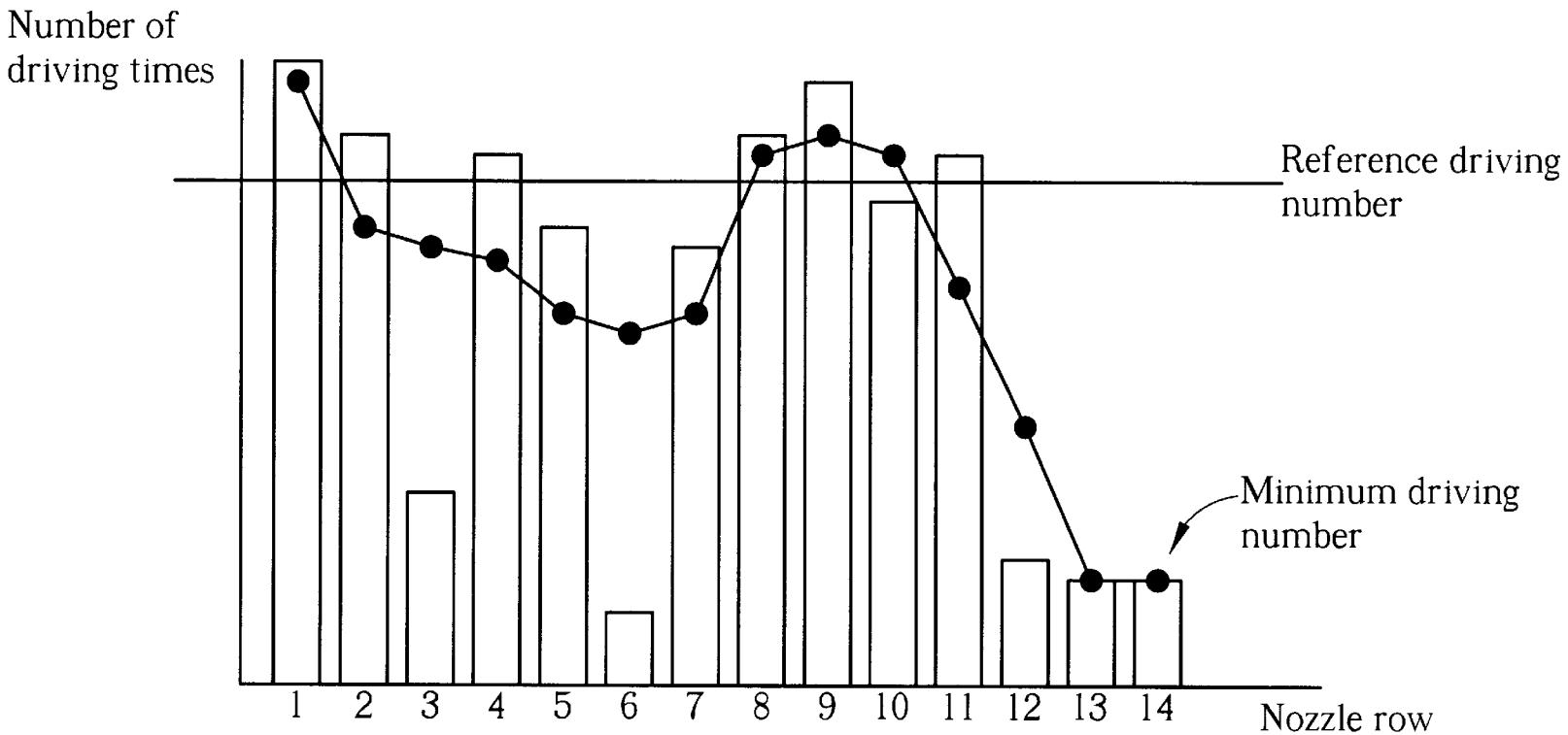
FIG. 5 is a diagram of a third preferred embodiment for determining a reference driving number and a minimum driving number.

The relation between each driving unit 55 and its neighboring driving units 55 may also be used to determine the servicing job required by each driving unit 55. In this situation, each driving unit 55 can have a different minimum driving number due to different numbers of times the adjacent driving units 55 have been driven. Please refer to FIG. 5. The data in FIG. 5 is the same as that in FIG. 3 and FIG. 4, but in FIG. 5 the minimum driving numbers used to determine the required servicing job for each driving unit 55 are different. With M (n)being the minimum driving number for the "n"-th nozzle, and F(n) being the number of times the "n"-th driving unit (corresponding to the "n"-th nozzle) is driven, the embodiment used in FIG. 5 applies the algorithm $M(n)=(F(n-1)+F(n)+F(n+1))/3$, i.e. the minimum driving number of the "n"-th nozzle is the (rounded off) average over the numbers of times the "n"-th nozzle and the nozzles adjacent to the "n-th" nozzle (the "(n−1)"-th and the "(n+1)"-th nozzles). As shown in FIG. 5, the driving units of the twelfth, thirteenth, and fourteenth nozzles are driven for similar numbers of times, but the minimum driving number of the twelfth nozzle is higher. Because the eleventh nozzle (adjacent to the twelfth nozzle) has been driven more times, the twelfth nozzle has a higher minimum driving number, which implies the twelfth nozzle should be driven for more times during the servicing of the ink jet printing head so as to compensate the significant status difference between the eleventh and the twelfth nozzles.

To sum up, the spirit of the present invention servicing method is to record the status (the number of times to be driven) of each driving unit and its corresponding nozzle, and to perform an appropriate service job corresponding to each driving unit and nozzle. The present invention reduces imbalances in different driving units and improves printing quality. These advantages can not be achieved by the prior art servicing method because the prior art servicing method performs identical service jobs on all nozzles without considering the different status of each driving unit and its corresponding nozzle. The above embodiments of the present invention show different approaches to determine the minimum driving number and the reference driving number. The present invention can also service the driving units and nozzles using several different driving signals with different power to heat a driving unit to achieve the temperature required for stability, or to eliminate bubbles or build-up accumulated on the driving unit and its corresponding nozzle.

Those skilled in the art will readily observe that numerous modifications and alterations of the device may be made while retaining the teachings of the invention. For example, the present invention can also be applied to other high-precision fluid ejection applications, such as fuel ejection systems, drug delivery systems, and direct print lithography, to name a few. Accordingly, the above disclosure should be construed as limited only by the metes and bounds of the appended claims.

What is claimed is:

1. A servicing method for servicing an ink jet printing device, the ink jet printing device comprising:

an ink jet printing head capable of moving back and forth along a print track to perform a printing job, the ink jet printing head comprising a plurality of nozzles and corresponding driving units for the nozzles;

the servicing method comprising:

recording a number of times each driving unit is driven after the driving unit has been driven to jet ink from the corresponding nozzle; and performing different service jobs according to a comparison between the number of times each driving unit is driven and first and second driving numbers so as to reduce differences between the nozzles.

2. The servicing method of claim 1 wherein if the number of times the driving unit is driven is smaller than the first driving number after comparison, then the service job of the driving unit is performed by sending a first driving signal to the driving unit.

3. The servicing method of claim 2 wherein the first driving signal is capable of driving the driving unit to jet ink from the corresponding nozzle for a number of times;

wherein the number of times to jet ink can be a predetermined value, a value equal to the difference between the first driving number and the number of times the driving unit is driven, or a value lass than the difference between the first driving number and the number of times the driving unit is driven.

4. The servicing method of claim 2, wherein the first driving signal is capable of heating the driving unit for a number of times with a power weaker than the power required to jet ink, wherein the number of times the driving unit is heated can be a predetermined value, a value equal to the difference between the first driving number and the number of times the driving unit is driven, or a value less than the difference between the first driving number and the number of times the driving unit is driven.

5. The servicing method of claim 1 wherein if the number of times the driving unit is driven is larger than the second driving number after comparison, then the service job of the driving unit is performed by sending a second driving signal to the driving unit.

6. The servicing method of claim 5 wherein the second driving signal is capable of driving the driving unit to eliminate build-up or bubbles accumulated near the driving unit or its corresponding nozzle.

7. The servicing method of claim 1 wherein the first driving number is a value that ensures stability of a driving unit.

8. The servicing method of claim 1 wherein the second driving number is a value that a predetermined amount of build-up has occurred near the driving unit or its corresponding nozzle.

9. The servicing method of claim 1 further comprising wiping each nozzle on the ink jet printing head.

10. The servicing method of claim 1 wherein the different service jobs are performed when the ink jet printing head has finished a predetermined number of times of printing jobs.

11. The servicing method of claim 1 wherein the different service jobs performed when the ink jet printing head has performed printing jobs longer than a predetermined period of time.

12. A ink jet printing device comprising:

an ink jet printing head capable of moving back and forth along a print track to perform a printing job, the ink jet printing head comprising a plurality of nozzles and corresponding driving units;

a recording module for recording a number of times each driving unit is driven to jet ink from the corresponding nozzle; and a controller capable of sending driving signals to drive the plurality of driving units to jet ink from the corresponding nozzles;

wherein when the ink jet printing head satisfies a predetermined service condition, the controller determines service job for each driving unit by comparing the number of times each driving unit is driven with a first driving number and a second driving number, and drives each driving unit to perform different service jobs according to the number of times each driving unit is driven so as to reduce differences between the nozzles.

13. The ink jet printing device claim 12 wherein the recording module comprises a plurality of counters, and each counter is electrically connected to a corresponding driving unit for recording the number of times the driving unit is driven to jet ink.

14. The ink jet printing device of claim 12 wherein the recording module is implemented as a recording program in a memory for recording the number of times each driving unit is driven to jet ink.

15. The ink jet printing device of claim 12 wherein if the number of times the driving unit is driven is less than the first driving number after comparison, then the controller sends a first driving signal to drive the driving unit.

16. The ink jet printing device of claim 15 wherein the first driving signal is capable of driving the driving unit to jet ink from the corresponding nozzle for a number of times, and wherein the number of times to jet ink can be a predetermined value, a value equal to the difference between the first driving number and the number of times the driving unit is driven, or a value less than the difference between the first driving number and the number of times the driving unit is driven.

17. The ink jet printing device of claim 15 wherein the first driving signal is capable of heating the driving unit a number of times with a power weaker than the power required to jet ink, and wherein the number of times to heat a driving unit can be a predetermined value, a value equal to the difference between the first driving number and the number of times the driving unit is driven, or a value less than the difference between the first driving number and the number of times the driving unit is driven.

18. The ink jet printing device of claim 12 wherein if the number of times a driving unit is driven is larger than the second driving number after comparison, then the controller sends a second driving signal to drive the driving unit.

19. The ink jet printing device of claim 18 wherein the second driving signal is capable of driving the driving unit to eliminate build-up or bubbles near the driving unit and its corresponding nozzle.

20. The ink jet printing device of claim 12 wherein the first driving number is a value that ensures stability of the driving units.

21. The ink jet printing device of claim 12 wherein the second driving number is a value that a predetermined amount of build-up has occurred near the driving unit.

22. The ink jet printing device of claim 12 wherein the ink jet printing head is further serviced by wiping each nozzle on the ink jet printing head with a wiper.

23. The ink jet printing device of claim 12 wherein the predetermined servicing condition is that the ink jet printing head has finished a predetermined times of printing jobs.

24. The ink jet printing device of claim 12 wherein the predetermined servicing condition is that the ink jet printing head has performed printing jobs longer a predetermined period of time.

25. A servicing method for servicing a fluid jetting apparatus, the fluid jetting apparatus comprising a plurality of nozzles and corresponding driving units for the nozzles; the servicing method comprising:

recording a number of times each driving unit has been driven to jet fluid from the corresponding nozzle;

when a predetermined servicing condition is satisfied, performing different service jobs for the driving units according to a comparison between the number of times each driving unit is driven and first and second driving numbers so as to reduce differences between the nozzles.

26. The servicing method of claim 25, wherein the predetermined servicing condition is that the fluid jetting apparatus has jetting fluid for a predetermined period of time.

* * * * *